United States Patent [19]

Wolfe, deceased et al.

[11] Patent Number: 4,510,487

[45] Date of Patent: Apr. 9, 1985

[54] POOL ALARM

[75] Inventors: Earle C. Wolfe, deceased, late of Marion, by M. Christine Wolfe, administrator; William G. Jobsky, Hopedale, both of Mass.; Thomas P. Smith, Miami, Fla.

[73] Assignee: Aaron Alarm Systems, Inc., New Bedford, Mass.

[21] Appl. No.: 356,831

[22] Filed: Mar. 10, 1982

[51] Int. Cl.[3] ..... G08B 21/00

[52] U.S. Cl. ..... 340/566; 200/84 C; 340/573

[58] Field of Search ..... 340/566, 573, 624; 200/84 C, 81.9 M, 82 E; 335/205; 73/DIG. 5

[56] References Cited

U.S. PATENT DOCUMENTS

| | | | |
|---|---|---|---|
| 3,504,145 | 3/1970 | Layher | 340/624 |
| 3,803,573 | 4/1974 | Schonger | 200/84 C |
| 4,087,706 | 5/1978 | Koester | 200/84 R |
| 4,442,405 | 4/1984 | Andrejasich et al. | 73/DIG. 5 |

*Primary Examiner*—Stephen A. Kreitman
*Assistant Examiner*—John E. Chapman, Jr.
*Attorney, Agent, or Firm*—Salter & Michaelson

[57] ABSTRACT

A switching device for effecting electrical continuity in an alarm circuit in response to the wave motion created by the ingress of a relatively large object into a pool of water or the like. The device includes an elongated member having an open interior chamber adjacent to its upper end, said chamber communicating with the exterior of said device and containing a float which is longitudinally movable within the chamber to effect electrical continuity between a pair of spaced electrical terminals in the member. The device is floatable in a pool of water or the like with at least the top portion of said member and said chamber above the surface of the water and with the bottom portion of said member extending well beneath the surface of the water. As the member bobs or oscillates in the water, the float moves upwardly within the chamber to effect continuity. However, since a substantial portion of the displacement volume of the device is disposed well beneath the surface of the water, the device oscillates primarily in response to low frequency subsurface waves which characteristically result from the ingress of an enlarged object into the water.

13 Claims, 7 Drawing Figures

POOL ALARM

BACKGROUND OF THE INVENTION

The instant invention relates to a device for detecting the ingress of an enlarged object into a fluid or liquid and more particularly to a switching device which is operable to activate an alarm circuit in response to the low frequency wave motion created by such ingress.

With the increased popularity of swimming pools and the like in recent years, a great need has arisen for providing a device which can automatically detect the ingress of an enlarged object such as a person into a swimming pool so that a signal may be transmitted to a remote location indicating that such ingress has taken place. The primary need for such a device stems from the obvious dangers inherent with swimming pools and the like relating to drownings, particularly in unattended pools. The instant invention fills this need by providing a device which is operative for actuating an alarm circuit upon the ingress of a relatively large object, such as a child, into a pool of water. In this regard, the device herein disclosed effectively discriminates between the high frequency surface waves which may be created by the wind or other environmental effects and the relatively low frequency waves which are characteristic of the ingress of an enlarged object into water, making it operable to activate an alarm circuit without resulting in excessive false alarms.

Previously known devices of this general type representing the closest prior art of which the applicant is aware are illustrated in the following U.S. Pat. Nos. HARTWICK, No. 12,717,935; MAC ANESPIE, No. 2,839,920; GERBER, No. 2,896,038; MALVINI, No. 3,058,101; MEYER, No. 3,204,232; SHERRICK et al, No. 3,707,940; TETRAULT, No. 3,468,283; and LAYHER, No. 3,504,145. Of these patents, it is felt that the patent to LAYHER represents the closest prior art known to the applicant. However, the device of the instant invention differs substantially from a conceptual standpoint from the device illustrated in the LAYHER patent in that it extends a substantial distance below the water level whereby it is effective for detecting the relatively low frequency subsurface waves created by the ingress of an enlarged object into the water. In this manner the device of the instant invention is effective for discriminating between those waves created by the ingress of an enlarged object and those waves created by the environment or smaller objects. The device herein disclosed also differs from the device illustrated in the LAYHER patent in that the float is adapted to be magnetically maintained at the top of the chamber after it has been moved upwardly by the wave motion to thereby reliably provide a continuous alarm signal upon activation in response to said low frequency wave motion. For these reasons, it is felt that the device of the instant invention represents a substantial improvement in the art, particularly as a result of the increased reliability thereof in actuating an alarm circuit with a relatively low incidence of false alarms.

SUMMARY OF THE INVENTION

The device of the instant invention comprises an elongated member having a weighted lower end and an open interior chamber adjacent to the upper end thereof. The device is constructed and dimensioned to make it floatable in substantially upright disposition in a pool of water or the like with the top portion of the device, including said chamber, normally being located above the surface of the water. Preferably the device extends at least two feet beneath the surface of the water which tends to make it relatively unresponsive to surface wave motion caused by the environment or by the ingress of smaller objects into the pool. By extending well beneath the surface, the device responds to low frequency subsurface wave motion which is characteristic of the ingress of enlarged objects into a pool. Communication is provided between the chamber and the exterior of the device by a passage extending into the chamber where a float carrying a magnet is provided. The float is somewhat protected from surface wave activity by the walls of the chamber; however, when the device is exposed to low frequency wave motion, the float moves upwardly within the chamber and thereby effects electrical continuity between a pair of electrical terminals mounted in the top portion of the member. Magnetic biasing retains the float at the top of the chamber once it has been moved upwardly by the wave motion to produce a continuous alarm signal until the device is manually reset.

The primary object of the instant invention is therefore to provide a switching device for swimming pool alarms and the like which reliably responds only to the wave motion created by the ingress of enlarged objects.

A further object is to provide a reliable switching device for swimming pool alarms and the like which responds only to low frequency subsurface wave motion rather than high frequency surface wave motion created by the environment.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
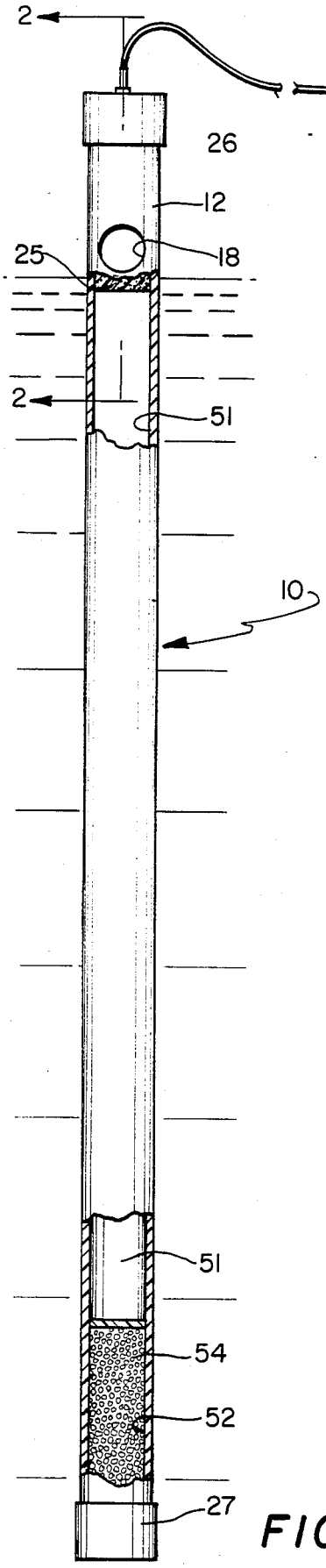
FIG. 1 is a side elevational view of the device of the instant invention connected to an alarm circuit, with portions broken away for purposes of illustration.

Referring now to the drawing, a first embodiment of the switching device of the instant invention is illustrated in FIGS. 1 through 4, generally indicated at 10. As will be noted, the device 10 comprises an elongated tubular member 12 which is preferably made of PVC or some other suitable corrosion resistant material and has an open interior chamber 14 containing a float 16 made of bouyant material, which is longitudinally movable within the chamber 14. A pair of apertures 18 provide communication between the chamber 14 and the exterior of the member 10.

Figure 2:
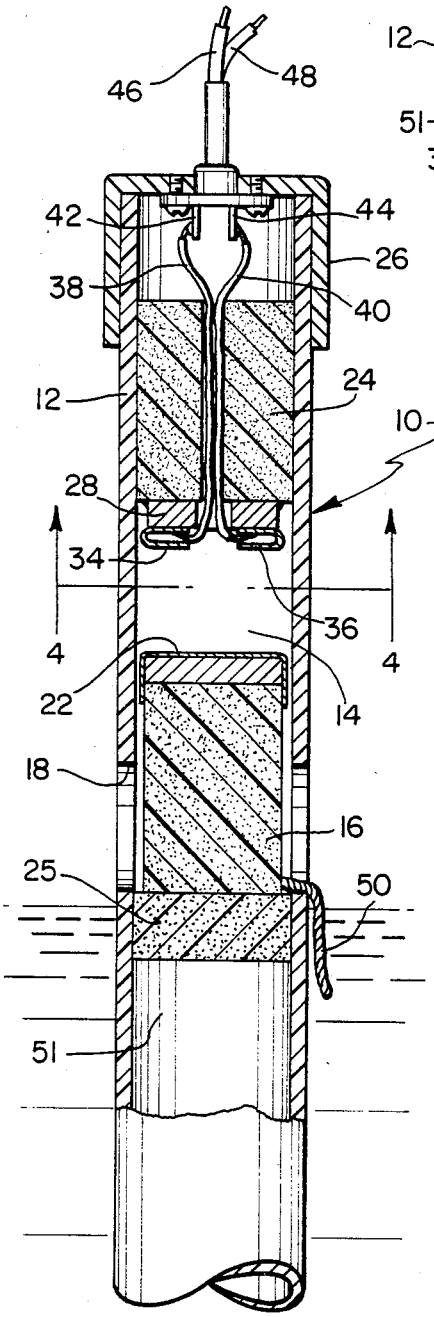
FIG. 2 is a sectional view thereof taken along line 2—2 in FIG. 1.
Figure 4:
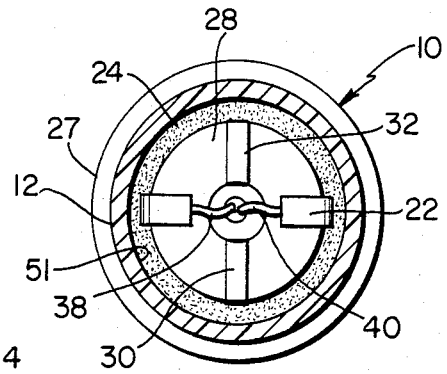
FIG. 4 is a sectional view taken along line 4—4 in FIG. 2.
Figure 3:
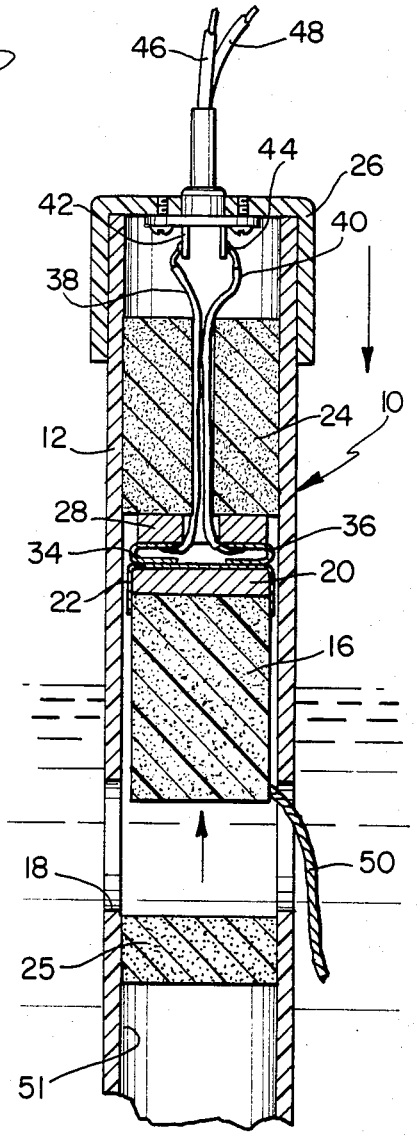
FIG. 3 is a similar sectional view illustrating the relative positions of the switching components of the device in the actuated position.

As will be noted, particularly from FIGS. 2 and 3, the float 16 travels vertically within the chamber 14 to effect the switching function of the device 10. In this regard the float 16 is preferably made of styrofoam or some other suitable bouyant material and carries a magnet 20 secured to float 16 by an aluminum cap 22.

Upper and lower plugs 24 and 25 respectively define the upper and lower ends of the chamber 14 being snuggly positioned within the member 12 to adjustably retain them in position. Preferably, the plugs 24 and 25 are positioned to allow the float 16 to travel approximately one inch in the chamber 14 with the lower plug 25 being slightly below the lower perepheries of the apertures 18 although other positions for said plugs 24 and 25 are possible. Upper and lower caps 27 and 26 are provided covering the ends of the member 12. An upper magnet 28, which is a nonelectrically conductive type magnet, is disposed at the upper end of the chamber 14, being attached to the plug 24 with aluminum bands 30 and 32, and a pair of spaced fixed contacts 34 and 36, substantially horizontally disposed, are mounted on the magnet 28 in underlying relation. The contacts 34 and 36 are electrically connected with wires 38 and 40 to terminals 42 and 44 mounted on the cap 26 and the terminals 42 and 44 are electrically connected with wires 46 and 48 to an alarm device 49.

In operation, the float 16 is movable beween the inoperative position illustrated in FIG. 2 where it is resting on the plug 25 and the operative position illustrated in FIG. 3 with the cap 22 engaging both of the fixed contacts 34 and 36 to provide electrical continuity therebetween to activate the alarm 49. In this manner the cap 22 acts as a movable bridging contact within the chamber 14, being magnetically held in engagement with the contacts 34 and 36 by the magnets 20 and 28, which are in opposite polar disposition to effect said magnetic attraction. A string 50 is provided attached to the float 16 extending through one of the apertures 18 to facilitate the disengagement of the cap 22 from the contacts 34 and 36 to reset the device 10.

Figure 5:
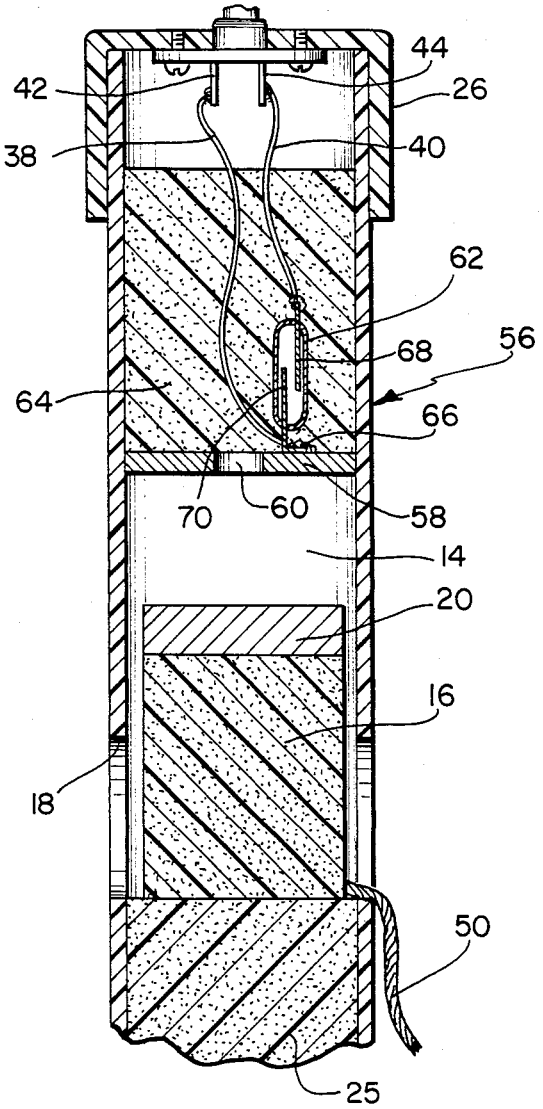
FIG. 5 is a fragmentary side sectional view of a second embodiment of the instant invention.
Figure 6:
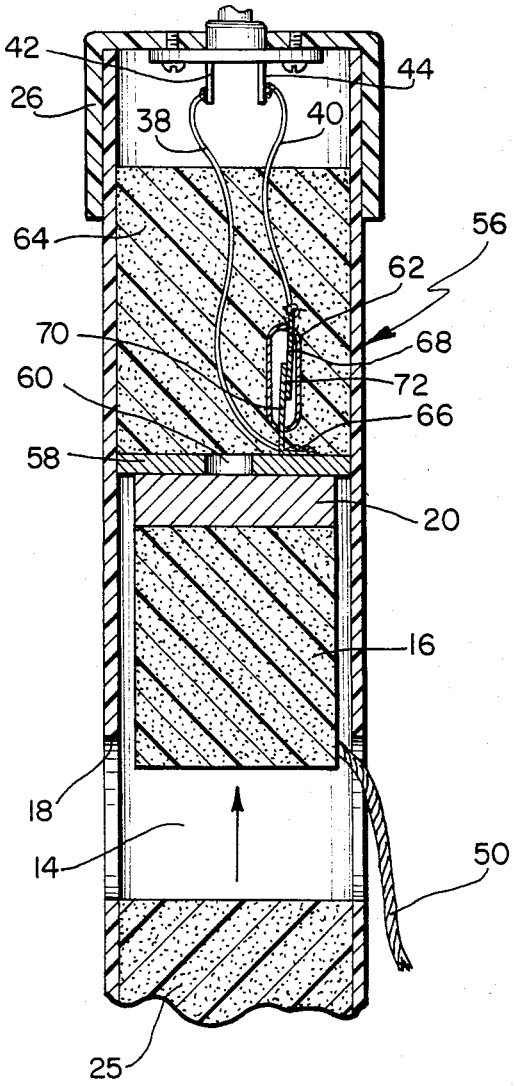
FIG. 6 is a similar sectional view illustrating the switching components in the actuated position.
Figure 7:
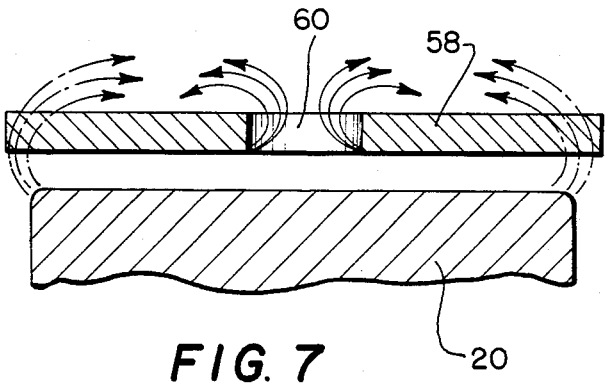
FIG. 7 is a sectional view illustrating the magnetic flux lines created by the magnet carried on the float as it approaches the top of the chamber.

A second embodiment of the device of the instant invention is illustrated in FIGS. 5 through 7 at 56. The device 56 operates on the same principle as device 10 and therefore includes the same elongated tubular member 12 which extends well beneath the surface of the water and has an open chamber 14 containing a longitudinally movable float which is operable to actuate an alarm circuit. As will be seen, however, although the switching components in the device 56 accomplish the same purpose as those in the device 10, they differ conceptually in the way they operate, being activated by magnetic flux lines rather than by direct engagement or bridging of contacts. As will be seen from FIG. 6, when the float 16 moves upwardly within the chamber 14 in the device 56, the magnet 20 is moved into magnetically biased engagement with a plate 58 which defines the upper end of the chamber 14. The plate 58 is made of a ferrous or other magnetically attractive material in a washer-like configuration having a central opening 60 as shown. A reed switch 62 which is embedded in potting fill 64 or some other suitable waterproof material is attached to the plate 58 as at 66 above the chamber 14. The reed switch 62 comprises a conventional reed switch having magnetically attractive contact elements 68 and 70 which are encapsulated in a glass envelope as shown and is connected with wires 38 and 40 to terminals 42 and 44. As will be seen most clearly from FIG. 7, when the float 16 moves upwardly within the chamber 14 so that the magnet 20 moves into magnetically biased engagement with the plate 58, the plate 58 itself becomes slightly magnetized causing secondary magnetic flux lines to develop around the opening 60 and around the perimeter of the plate 58 as shown. Since the plate 58 is of circular washerlike configuration having a central opening as shown, the magnetic flux lines created are directed radially outwardly from the opening 60 and radially inwardly from the perimeter of the plate 58. Accordingly, by positioning the reed switch 62 in close proximity to the plates 58, the elements 68 and 70 are magnetically attracted to an operative position as shown when the magnet 20 is moved into engagement with the plate 58, thus effecting electrical continuity in the alarm circuit. Since the elements 68 and 70 are completely encapsulated in the switch 62 and are magnetically activated solely by the secondary flux lines as shown, they are not exposed to dampness, corrosion, etc., and therefore provide durable and reliable switching components for the device 56. Although not essential, it is possible to provide further isolation of the switch 62 by suspending it in the potting fill 64 in close proximity to the plate 58 rather than having it actually attached thereto since direct contact between these elements is not required. However, in most cases it is desirable to have the switch 62 attached to the plate 58 as an expedient in construction to assure proper positioning of the switch 62 in the material 64. As will be further noted, in the device 56 the magnet 20 is adhered to the float 16 by cementing or the like rather than by means of the aluminum cap 22 as in the device 10 so that the flux lines from the magnet 20 are completely obstructed.

As will be noted, the devices 10 and 56 are preferably floatable in water or other liquid with the lower periphery of the apertures 18 thereof spaced slightly above the surface of the liquid. As will be further noted, the devices 10 and 56 each include air chambers 51 and lower ballast chambers 52 containing weighted materials 54. While it is understood that the devices 10 and 56 could be adapted for use in liquids of virtually any density, the devices herein disclosed are directed particularly for use in water. In this connection the chambers 51 and 52 are dimensioned and the weighted materials 54 are selected so that the devices 10 and 56 float substantially as described, i.e., with the surface of the water slightly below the apertures 18.

In order for the devices 10 and 56 to effect switching functions in alarm circuits only in response to the ingress of relatively large objects into pools of water, they must respond only to the waves created by such ingress and not to waves created by other sources such as the environment. It has been found that the waves created by the ingress of enlarged objects, such as a person, into a pool of water are relatively low frequency waves. These waves extend well below the surface of the water traveling as invisible shock waves. In contrast, the waves created by the ingress of smaller objects or by the wind are relatively high frequency waves which are limited primarily to the surface of the water. By extending well beneath the surface of the water with a substantial portion of the displacement volumes thereof therebeneath, the devices 10 and 56 respond only to relatively low frequency subsurface waves and do not respond substantially to high frequency surface effects.

When either of the devices 10 or 56 are exposed to high frequency surface wave motion, they remain substantially stationary since a major portion of the displacement volumes thereof are well beneath the surface where the effects created by these waves are minimal. On the other hand, when they are exposed to low frequency subsurface wave motion, they bob or oscillate in response thereto. In this connection the devices 10 and 56 are preferably at least 30 inches in length having at least 24 inches of said length beneath the surface of the water to respond to the subsurface motion. Preferably also, as hereinbefore noted, the lower peripheries of the apertures 18 are spaced slightly above the bottoms of the chambers 14 and also slightly above the surface of the water or other liquid. By positioning the floats 16 within the chambers 14 with the apertures 18 disposed in this matter, the floats 16 are somewhat shielded from the high frequency wave motion on the surface of the water or liquid by the walls of the chambers 14 so that they remain relatively stationary in said chambers. However, when the devices 10 or 56 "bob" or oscillate in response to low frequency wave motion, the respective chambers 14 thereof are submersed causing relative movement between the respective floats 16 and the members 12 thereof to activate their respective alarms 49.

It is seen therefore that the devices 10 and 56 are operable for selectively effecting electrical continuity in alarm circuits in response to low frequency subsurface wave motion of the type characteristic of the ingress of enlarged objects into pools of water, and particularly when such enlarged objects splash into the water. Since the devices 10 and 56 don't respond significantly to high frequency surface motion, they are substantially more reliable than the devices previously known, resulting in significant reductions in the incidence of false alarms. The instant invention therefore represents a significant improvement in the art of pool alarm switching devices which should be of major commercial significance.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A switching device for effecting electrical continuity in an alarm circuit in response to wave motion in a fluid comprising:

a. an elongated member having an open interior chamber adjacent an end thereof and a passage which provides communication between said chamber and the exterior of said device, said elongated member being floatable in said fluid with the top portion of said chamber above the surface of said fluid and with the lower portion of said elongated member extending to a depth of at least two feet beneath the surface of said fluid, whereby said elongated member is responsive to wave motion in said fluid which extends to a depth of at least two feet in said fluid to provide a bobbing effect on said elongated member but it is relatively unresponsive to surface wave motion which is substantially confined to the surface areas of said fluid;

b. a float disposed within said chamber and movable therein in a longitudinal direction with respect to said elongated member in response to bobbing movement of said elongated member, said float being movable in said chamber between lower and upper positions therein; and c. sensing means in said chamber responsive to movement of said float from said lower position to said upper position to effect continuity in said alarm circuit.

2. The device of claim 1, further comprising means releasably retaining said float in said upper position upon upward movement of said float thereto.

3. In the device of claim 2, said retaining means comprising a magnet.

4. In the device of claim 1, said sensing means comprising a pair of spaced contacts mounted adjacent the upper end of said chamber and a movable contact carried by said float, said movable contact being simultaneously engageable with said spaced contacts to effect electrical continuity therebetween upon said upward float movement.

5. In the device of claim 1, said member being at least 30 inches long.

6. In the device of claims 1, 4 or 5, said passage comprising an aperture extending from the exterior of said device to said chamber, the lower periphery of said aperture being slightly above the surface of said fluid when said device is floating therein and said fluid is substantially free from wave motion.

7. In the device of claim 1, said float traveling longitudinally approximately one inch within said chamber to effect said continuity.

8. In the device of claim 1, said sensing means comprising a pair of normally spaced contacts mounted adjacent the top of said chamber and connected to the alarm circuit, whereby when said contacts are open the circuit is inoperative and when said contacts are closed the circuit is operative, and means effecting electrical continuity between said contacts upon upward movement of said float to the upper end of said chamber to thereby close the circuit, said contacts being magnetically actuatable to said closed position, said means for effecting continuity comprising magnetic means carried by said float magnetically actuating said contacts to said closed position upon said upward float movement.

9. The device of claim 8 further comprising means retaining said float at the upper end of said chamber upon upward movement of said float thereto.

10. In the device of claim 9, said retaining means comprising magnetically attractive means mounted at the upper end of said chamber, said magnet and said magnetically attractive means cooperating to retain said float.

11. In the device of claim 10, said magnetically attractive retaining means comprising a magnetically attractive disc having an aperture therethrough mounted in substantially transverse disposition in said member adjacent to said contacts.

12. In the device of claim 8 said contacts being a reed switch.

13. In the device of claim 10, said contacts further characterized as comprising a reed switch which is vertically disposed above said disc, said magnet cooperating with said disc to produce a magnetic force field above said disc which activates said reed switch upon movement of said magnet into proximity with said disc.

* * * * *